United States Patent [19]

Gratzl et al.

[11] 4,171,574

[45] Oct. 23, 1979

[54] DRAWING AND PAINTING INSTRUMENT FOR GRAPHIC DESIGNS

[75] Inventors: Daniel E. Gratzl; Frank J. Matranga, both of Addison, Ill.

[73] Assignee: Creative Insights, Inc., Addison, Ill.

[21] Appl. No.: 950,868

[22] Filed: Oct. 12, 1978

[51] Int. Cl.[2] ..... B05C 17/12; B41F 31/24; B43L 9/04

[52] U.S. Cl. ..... 33/27 C; 15/210 R; 15/244 R; 33/42; 101/379

[58] Field of Search ..... 15/166, 210 R, 244 A, 15/248 R; 33/27 C, 42; 101/379; 401/193

[56] References Cited

U.S. PATENT DOCUMENTS

| | | | |
|---|---|---|---|
| 1,930,358 | 10/1933 | Helmenstein | 33/27 C |
| 3,263,334 | 8/1966 | Mutter | 33/27 C |
| 3,708,821 | 1/1973 | Chase et al. | 15/210 R |
| 3,817,178 | 6/1974 | Hagen | 33/27 C |

*Primary Examiner*—Daniel Blum

*Attorney, Agent, or Firm*—Merriam, Marshall & Bicknell

[57] ABSTRACT

An instrument for making graphic designs on walls or ceilings, including an elongated member having a plurality of rigid sections joined together by a unitary, integral flexible portion, center-line apertures spaced along the longitudinal axis of each rigid section providing a pivot point and a plurality of marking points along the instrument, each section having paired edge apertures spacially located along respective, opposite longitudinal edges of each section, and a paint pad having a pair of upstanding lugs for detachably mounting the paint pad at a selected pair of edge apertures to selectively place painted arc segments or stripes on walls or ceilings. A guide member having rollers can be mounted to one end of the instrument to aid in placing vertical or horizontal stripes on walls or ceilings. For very large wall or ceiling surfaces a link member can be used to couple together two instruments.

10 Claims, 12 Drawing Figures

DRAWING AND PAINTING INSTRUMENT FOR GRAPHIC DESIGNS

This invention relates to instruments or devices for placing graphic designs, ornamentation or decoration on walls or ceilings, and particularly to such instruments and devices including means for drawing or painting vertical and horizontal lines or arcs either pencil width or in the form of wider stripes or segments.

BACKGROUND OF THE INVENTION

Reference may be made to the following U.S. Pat. Nos. of interest: 824,299; 3,081,545; 3,263,334; 3,817,178; and 2,555,741.

There is at present a persistent demand for providing the decoration or ornamentation of both walls or ceilings in new and existing structures using graphical designs consisting of painted arcs or vertical and horizontal and transverse line segments. Currently, such ornamentation is normally accomplished by either freehand painting the desired graphic design or by utilizing standard straight edges and a number of circular edges each of a different diameter.

Freehand drawing or decorating requires a considerable amount of artistic skill and steadiness in the decorator. In addition, in large wall or ceiling surfaces, it is very difficult and near impossible to maintain consistency in drawing line segments or arcs. On the other hand, while there exists or can be devised a number of drafting-type instruments for pencil or ink drawing of line segments and arcs, such as illustrated in the aforementioned U.S. Pat. Nos. 824,299; 3,081,545; and 3,263,334, they do not disclose or teach any means for painting, nor are they readily adapted for decorating large surfaces such as walls or ceilings with graphical designs. U.S. Pat. No. 3,817,178 is helpful in applying a specific repetitive pattern onto a wall or ceiling, however there are no means shown or suggested for placing vertical or horizontal line segments or arcs of the desired width onto such surfaces.

SUMMARY OF THE INVENTION

Therefore, in accordance with the principles of the present invention, there is provided an instrument having a plurality of elongated sections each joined by a flexible unitary portion so that either a single section or an elongated member formed of the composite sections can be positioned to lay adjacent the wall or ceiling surfaces. Each section includes a series of spaced apertures extending substantially along the longitudinal center line of said sections and adapted to provide a pivot point at one end and means for receiving a marking device at the other end for drawing arcs of any desired radius on the wall or ceiling surface. Each elongated instrument section further includes a series of spaced apertures extending along the opposite longitudinal edges of each section. One aperture on each longitudinal edge forms paired edge apertures, the centers of each of which are aligned with one of the center-line apertures spaced along the section center line.

A paint pad with a bottom foam pad portion for painting arcs or vertical and horizontal segments includes a pair of pegs on the upper portion of the paint pad. The pegs can be inserted into one of the respective paired apertures on the instrument section to place the bottom foam pad portion adjacent the wall or ceiling surface. The paint pad can be detachably mounted at different paired edge apertures on the sections to provide concentric painted arcs in the graphical design. In addition, the paint pad diameter is dimensioned with respect to center distance between the center-line apertures so that the painted arcs will cover the outlined markings previously placed on the surface using the center-line apertures.

A roller guide is adapted to detachably mount at one end of the elongated instrument section and includes a pair of rollers for engaging the wall of ceiling surfaces and thereby maintaining equal distant spacing of the center-line and edge apertures with respect thereto. This permits vertical or horizontal lines or painted segments using the detachable paint pad to be graphically imprinted on the surfaces. A connecting or link member is also provided for joining together two elongated members where ornamentation is to be provided on very large surfaces. On rather small surfaces or in corners, the single elongated member can be bent at its flexible portion in order to draw small arcs or short line segments.

DETAILED DESCRIPTION

Figure 1:
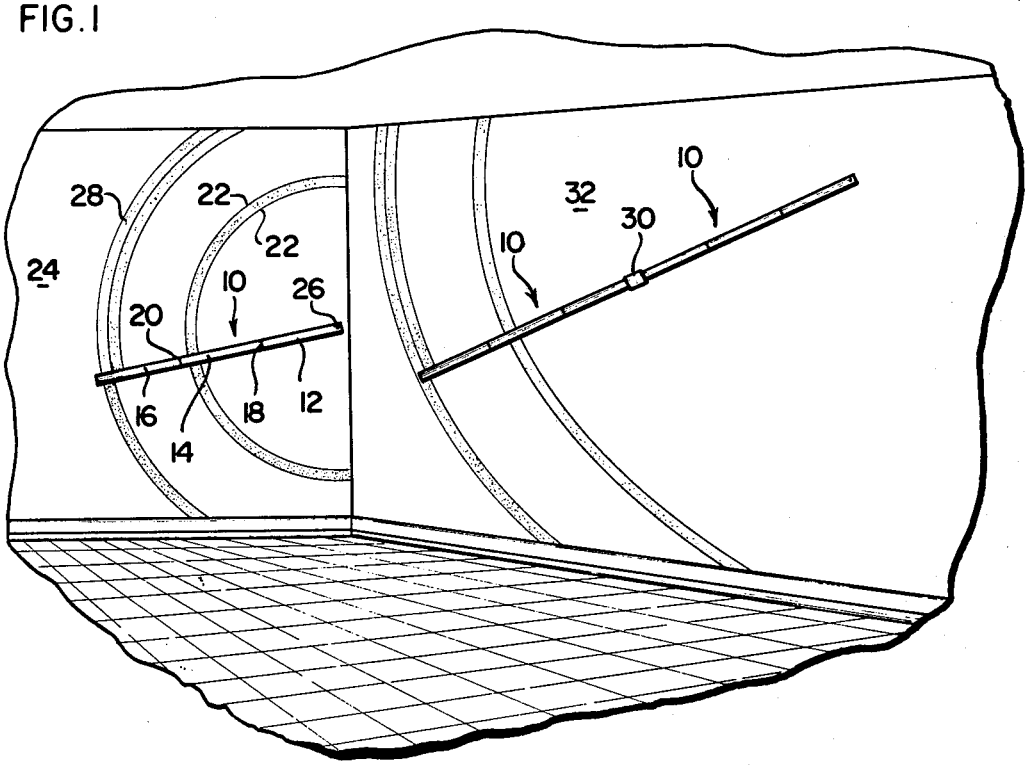
FIG. 1 is a perspective view illustrating two walls, a ceiling and floor of a room with a graphical design being applied to the walls by means of an instrument constructed in accordance with the principles of the present invention.

Referring now to FIG. 1 there is illustrated an instrument 10 for placing graphic designs, ornamentation or decoration on walls or ceilings of a room. The instrument 10 includes a plurality of elongated sections such as 12, 14 and 16 interconnected by integral flexible portions 18 and 20.

As illustrated in the left-hand portion of FIG. 1, a pair of concentric outlined arc segments 22 have been placed on wall 24 by inserting a pin or other rigid device through center-line pivot aperture 26 at one end of the instrument and a pencil or other marking device through respective center-line apertures in instrument section 14. A painted arc segment 28 upon wall 24 is provided by attaching a paint pad to instrument section 16 as will be described hereinafter. In accordance with another aspect of the present invention, the right-hand portion of FIG. 1 illustrates two graphical design instruments 10 interconnected by means of a linking member 30 for providing the illustrated arcs on wall 32.

Figure 2:
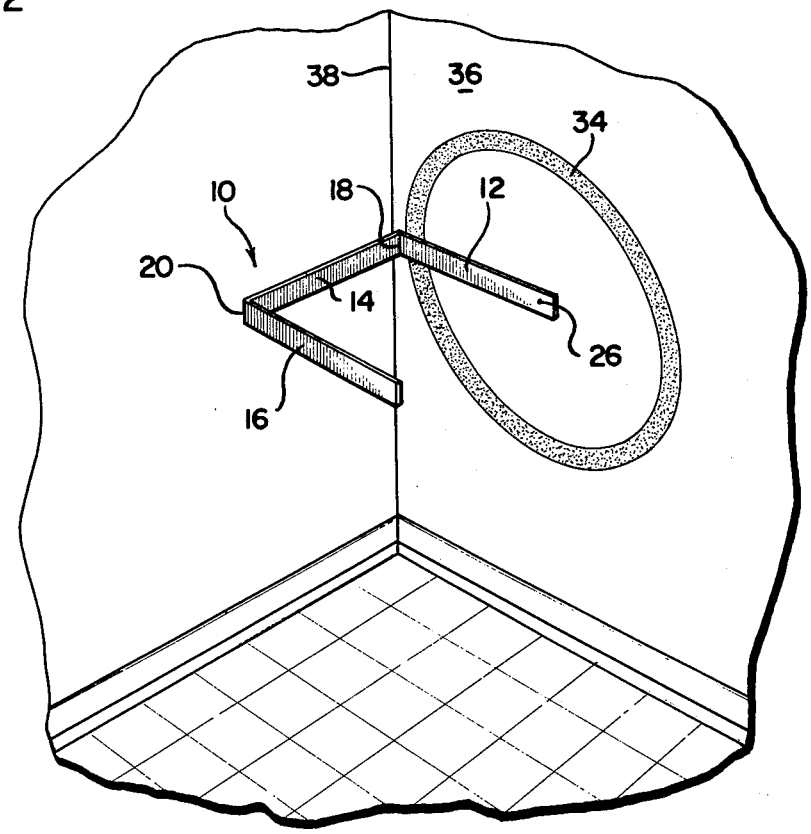
FIG. 2 is a perspective view illustrating an inside corner wall of a room with a small circular graphical design being applied to one of the walls with the elongated instrument being folded in accordance with one aspect of the present invention.

FIG. 2 illustrates another aspect of the present invention wherein the instrument 10 has been folded along flexible sections 18 and 20. This permits a paint pad attachable to the instrument section 12 as will be described hereinafter to place a circular painted section 34 about pivot point 26 on the respective wall 36 at a position closely adjacent the wall corner 38.

Figure 3:
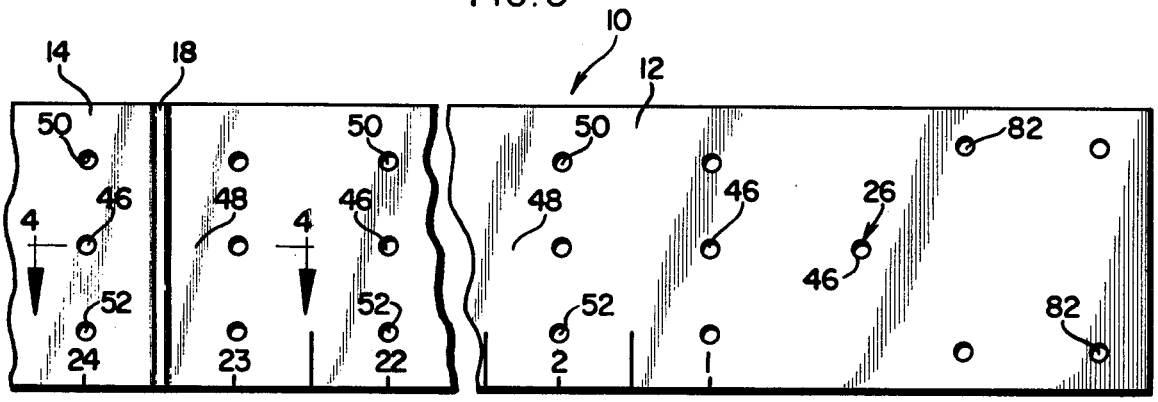
FIG. 3 is a fragmented elevational view illustrating one end of the graphic design instrument showing the center-line pivot and marking apertures and the paired edge apertures along the longitudinal section edges for attaching a paint pad.
Figure 4:
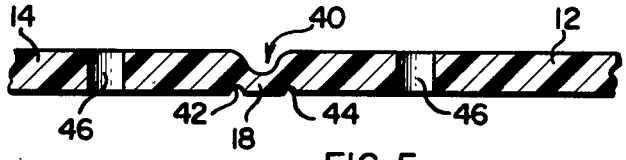
FIG. 4 is a sectional view taken along section line 4—4 of FIG. 3 illustrating the flexible portion integrally formed in and interconnecting two adjacent sections of the instrument.

As shown in FIG. 3, one end of the graphic design instrument 10 includes the elongated, substantially rectangular sections 12 and 14 joined by a flexible portion 18. The instrument can be formed of a rigid plastic material so as to comprise the several substantially rectangular sections 12, 14 and 16 as shown in FIG. 1 formed integrally with portions 18 and 20 having material removed therefrom to form groove 40 on one side and smaller grooves 42, 44 on the other side, thereby enabling the portion 18 to be flexible. The techniques for forming the several hard plastic sections with the integral, flexible portions therebetween are well-known in the plastic art.

Each of the elongated instrument sections 12, 14 and 16 is provided with a series of center-line apertures 46 spaced equidistant along the longitudinal axis or center line 48. FIG. 3 illustrates the center to center distance as one inch, although more or less spacing can be provided as desired. A series of respectively paired edge apertures 50, 52 are also included on the longitudinal opposite edges of the instrument sections as shown in FIG. 3. Furthermore, as can clearly be seen from FIG. 3, the center of each respectively paired edge apertures 50 and 52 is aligned with one of the section center-line apertures 46. Also, it may be noted that the instrument sections 12, 14 and 16 further include dimensional indicia along one edge thereof aligned with the respective center-line apertures 46 and paired edge apertures 50 and 52. Thus, the outline markings 22 shown in FIG. 1 can be made by inserting a pin or other hold-down means through pivot point 26 located at the first center-line aperture 46, placing a pencil or other marking device through one or more of the other center-line apertures 46, and rotating the instrument 10 about the pivot point 26.

Figure 5:
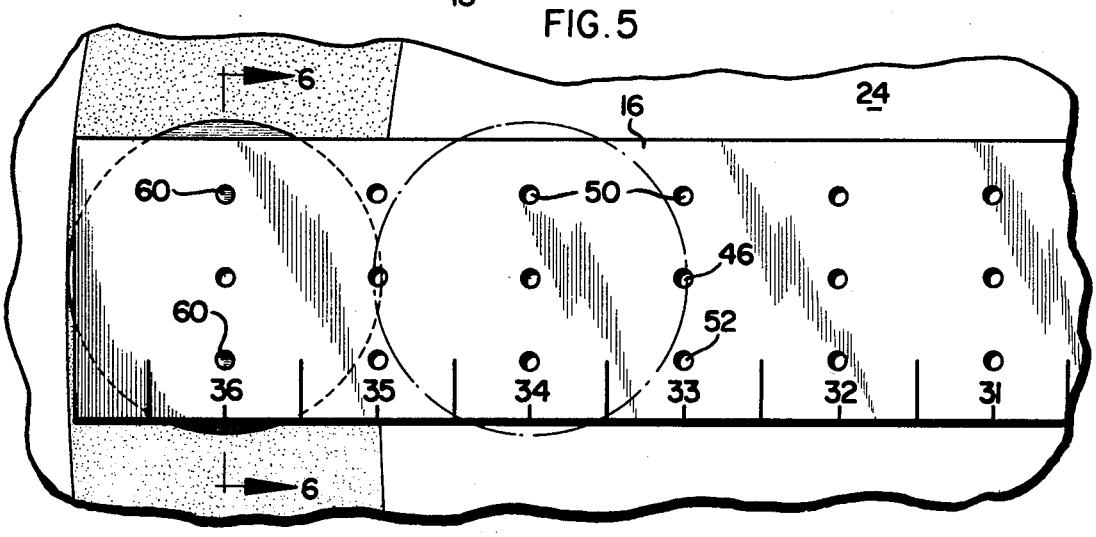
FIG. 5 is a fragmented elevational view illustrating the other end of the graphic design instrument from that shown in FIG. 3 having a paint pad attached for providing the arcs illustrated in FIG. 1.
Figure 6:
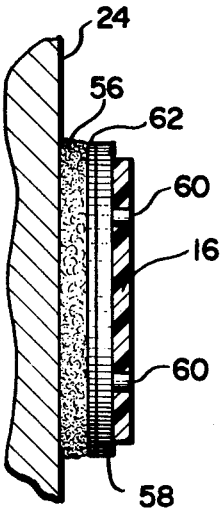
FIG. 6 is a sectional view taken along section lines 6—6 of FIG. 5 showing the paint pad detachably mounted between the wall surface and one section of the graphical design instrument.
Figure 7:
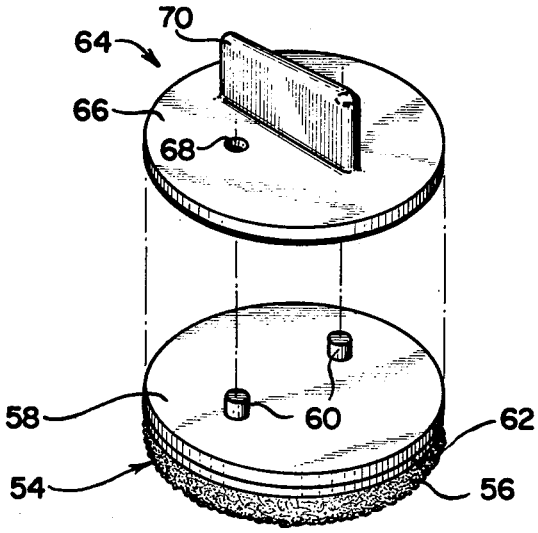
FIG. 7 is a perspective view illustrating a paint pad with a paint pad handle shown in the detached upper portion thereof.

Referring now to FIGS. 5–7, there is illustrated the attachment of a paint pad 54 to instrument section 16 for providing a painted arc segment 28 onto wall 24 as illustrated in FIG. 1. Paint pad 54 includes a bottom foam pad 56 mounted to a rigid top plate 58.

Foam pad 56 is formed of a suitable soft, resilient material adapted for receiving paint and transferring the paint to a surface when placed in contact therewith. Various types of material are readily available for such use. A pair of cylindrical pegs 60 extend upwardly from plate 58 and are sized with respect to the paired edge apertures 50 and 52 so that the pegs can be inserted into a respective aperture for releasably mounting the paint pad to one of the instrument sections. Thus, as shown in FIG. 5, paint pad 54 is mounted to instrument section 16 at the paired edge apertures 50 and 52 aligned with the 36 inch indicia on section 16. As illustrated in the cross-sectional view of FIG. 6, foam pad 56 is adhesively bonded or otherwise secured to a thin disc 62, with the disc 62 in turn being bonded to the top plate 58. The diameter of top disc plate 58 is slightly larger than the width of instrument section 16. This can be seen from FIGS. 5 and 6. This is provided in order to enable the pad 54 to be readily attached and detached from the instrument sections by gripping the edge of plate 58 or disc 62 when attaching or detaching the paint pad.

It is understood, of course, that the pad 54 can be mounted with the upstanding lugs 60 engaging any of the paired edge apertures 50, 52 along the instrument. As an example, in FIG. 5, at the 34 inch marker, there is indicated in dashed lines a paint pad 54 after having been removed, for instance, from the 36 inch location. It may be noted that the diameter of the paint pad is slightly greater than two inches so as to provide a slight overlap at the 35 inch location thereby covering with paint any pencil or other marker lines that may have been previously placed at this location. In conjunction with the paint pad 54, there is also provided handle adapter 64 including a disc portion 66 having apertures 68 for engaging lugs 60. A handle 70 extends upwardly from the disc 66 for attaching the handle adapter to the paint pad and for use of the paint pad during graphical designing on the walls or ceilings.

Figure 8:
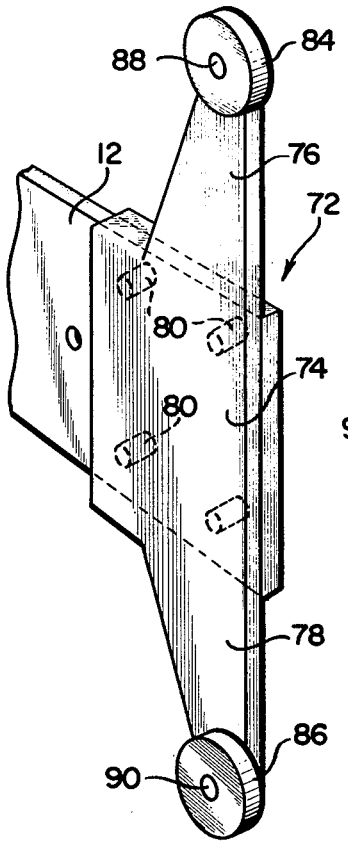
FIG. 8 is a perspective view showing one fragmented end section of the graphical design instrument and including a roller guide detachably mounted thereon.
Figure 9:
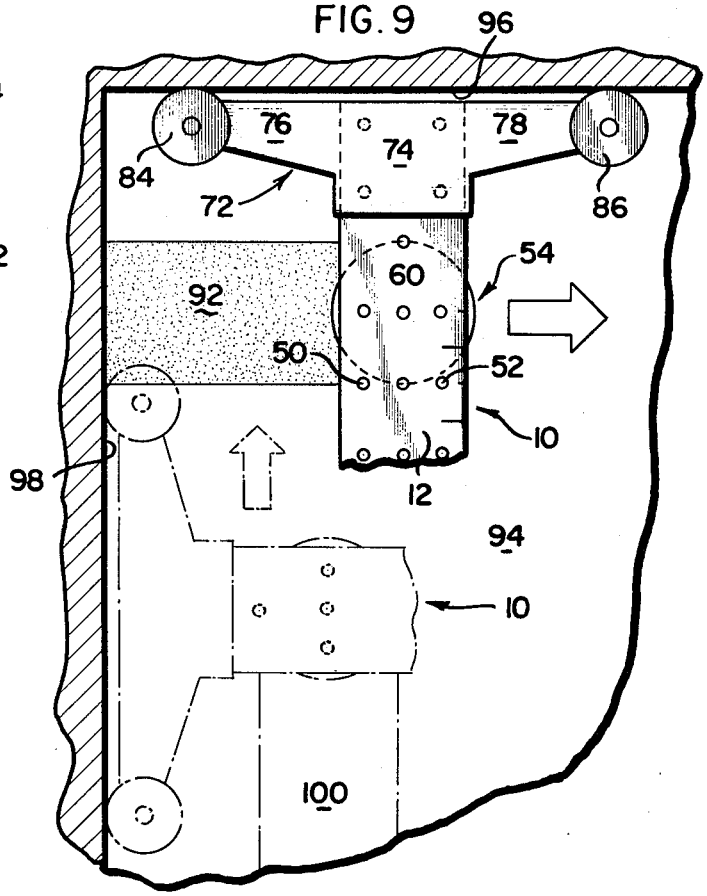
FIG. 9 is a fragmentary elevational view showing a room corner with the roller guide adapted to roll along the ceiling permitting the attached paint pad to place a horizontal painted segment thereon, with the dashed line illustrations showing the roller guide adapted for placing a painted vertical segment thereon.

FIGS. 8 and 9 illustrate apparatus in accordance with the principles of the present invention adapted for readily providing vertical and horizontal graphic segments on walls or ceilings. Guide member 72 includes a central, generally rectangular member 74 and two wing sections 76, 78 extending respectively from the central portion 74. Central section 74 includes four projecting lug members 80 each of which is dimensioned to fit within the guide member mounting apertures 82 located at the end of instrument section 12 as shown in FIG. 3. Each of the wing-like projecting sections 76, 78 has mounted on the end thereof an associated roller 84, 86 rotatably mounted to the wing sections by suitable support means such as axle 88, 90.

In using the roller guide member 72, the unit is placed as shown in FIG. 8 with the four lugs 80 inserted into the mounting apertures 82. It is understood, of course, that the lugs and apertures are dimensioned so that the guide member can be readily detachably engaged from the instrument section 12.

In FIG. 9, instrument 10 is shown with roller guide member 72 and with paint pad 54 mounted in position for providing horizontal painted segment 92 on wall 94.

In particular, it may be noted that the rollers 84 and 86 rollingly engage ceiling 96 as instrument 10 is moved in the indicated arrow direction to place a horizontal stripe or painted segment 92 onto the surface 94. FIG. 9 also includes in the dashed line portion thereof placement of the instrument so that rollers 84 and 86 engage wall 98. Thus, in the dashed line portion, movement of the instrument 10 upwardly in the indicated arrow direction will provide a vertical stripe 100 onto wall 94. It is understood, of course, that painted stripes parallel to either the horizontal stripe 92 or the vertical stripe 100 are readily provided by detaching paint pad 54 from the indicated location and mounting the pad at one of the other locations on sections 12, 14 or 16 defined by the paired edge apertures 50, 52.

Figure 10:
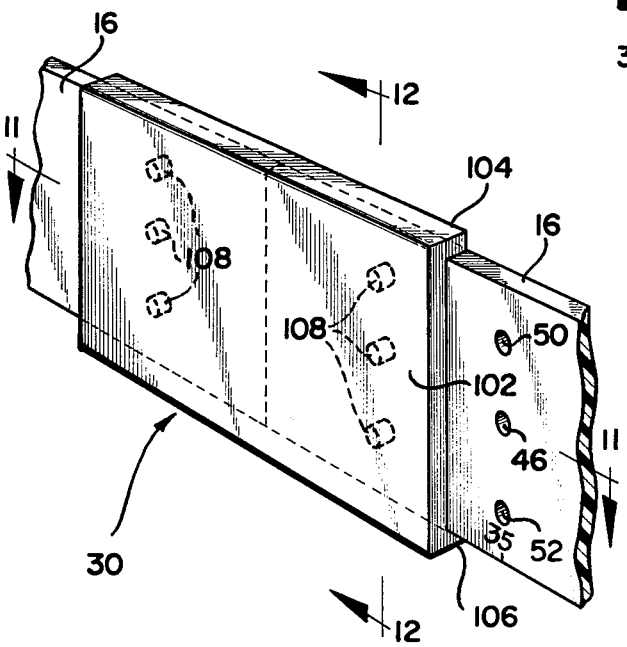
FIG. 10 is a fragmentary perspective view illustrating the ends of two graphical design instruments being coupled by means of an attaching or linking device for lengthening the instrument for large wall surface applications such as shown in the right-hand portion of FIG. 1.
Figure 11:
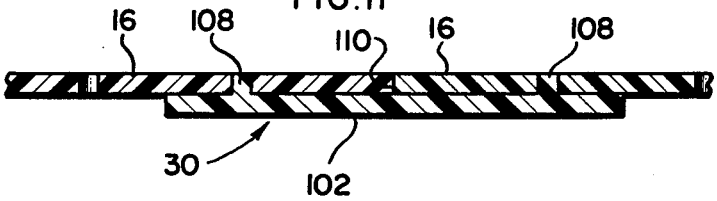
FIG. 11 is a sectional view taken along section line 11—11 of FIG. 10 illustrating the linking device mounted in position.
Figure 12:
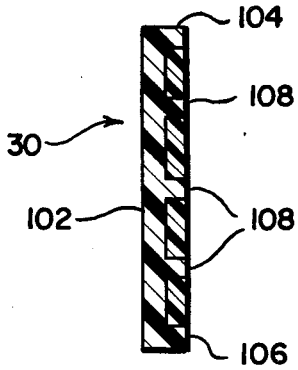
FIG. 12 is a sectional view taken along section line 12—12 of FIG. 10 illustrating the pegs of the linking device snug fitted within the center-line aperture and the paired edge apertures of the instrument.

As indicated in the right-hand portion of FIG. 1, in some instances large diameter arcs or stripes are to be provided, for which there has been included a link member 30 joining together two of the instruments. Such a link member is illustrated in FIGS. 10–12 and includes a rigid channel 102 having opposite upstanding edges 104, 106. Edges 104 and 106 define a cavity portion therebetween dimensioned so as to accommodate, for instance, section 16 of two individual instruments 10. Channel 102 includes two sets of three each, upstanding lugs 108 for engaging respective paired edge apertures 50, 52 and an associated center-line aperture 46 on each of the section 16 members. As can be seen from FIG. 11, the separate section 16 members when placed end-to-end butt together at junction 110. Also, lugs 108 are dimensioned with respect to the apertures 50, 52 and 46 so as to resiliently, yet singly fit therein. The butted junction 110 and the snug fit engagement of lugs 108 in apertures 50, 52 and 46 enables the link member 30 to maintain the individual instruments 10 in position during use as illustrated in the right-hand portion of FIG. 1.

While particular embodiments of the present invention have been shown and described, it will be obvious to those skilled in the art that various changes and modifications may be made without departing from the invention in its broader aspects. Accordingly, the aim of the appended claims is to cover all such changes and modifications as may fall within the true spirit and scope of the invention.

What is claimed is:

1. An instrument for making graphic designs in ornamenting or decorating walls or ceilings comprising:

an elongated, unitary member including a plurality of substantially rigid, elongated sections and flexible portions integral with and interconnecting each of said rigid sections for positioning one or more of said sections adjacent said wall or ceiling;

said elongated member having a series of center-line apertures spacially separated and located along the longitudinal axis of said elongated sections thereof adapted for providing a pivot point at one of said center-line apertures and a plurality of marking points at any of the other of said center-line apertures for receiving a marking device and marking arcs on walls or ceilings by pivoting said member about said pivot point;

a series of paired edge apertures on said elongated sections extending along respective opposite longitudinal edges of said sections, each pair of edge apertures comprising respective apertures transversely aligned on said opposite longitudinal section edges; and a paint pad having a bottom foam pad portion for receiving paint to be applied from said foam pad onto said walls or ceilings, and a top plate including a pair of upstanding pegs adapted to firmly engage a respective one of said paired edge apertures in mounting said paint pad to said elongated member intermediate one of said sections and said wall or ceiling for making painted arc segments.

2. An instrument according to claim 1, wherein the centers of each of said paired edge apertures are aligned with a respective one of said center-line apertures.

3. An instrument according to claim 1, wherein said upstanding pegs are adapted to be readily engageable and disengageable with said paired edge apertures to selectively mount said paint pad at desired locations along said instrument.

4. An instrument according to claim 3, wherein said top plate extending slightly beyond the width of said elongated sections when mounted thereon to provide a gripping edge enabling ready mounting and dismounting of said paint pad to said sections.

5. An instrument according to claim 1, wherein said bottom foam pad is disc shaped.

6. An instrument according to claim 5, wherein the radius of said disc shaped bottom foam pad is slightly larger than the center to center distance between adjacent center-line apertures.

7. An instrument according to claim 1, including a guide member and mounting means for mounting said guide member at the end of one of said elongated sections to guide said instrument during the painting of vertical or horizontal stripes.

8. An instrument according to claim 7, wherein said guide member includes a central portion, a wing-like portion extending from each side thereof, and a roller rotatably mounted to each wing-like portion and adapted to be positioned along the ceiling for making horizontal stripes and along the wall for making vertical stripes.

9. An instrument according to claim 8, wherein said mounting means includes a plurality of lugs projecting from said central portion and a corresponding plurality of mating apertures at said elongated section end.

10. An instrument according to claim 1, including a pair of said elongated, unitary members, each having a plurality of said substantially rigid, elongated sections, and linking means interconnecting the respective ends of said members for aiding in placing graphic designs on very large wall or ceiling surfaces.

* * * * *